United States Patent [19]

Ogawa

[11] Patent Number: 4,496,297

[45] Date of Patent: Jan. 29, 1985

[54] ROTARY VANE PUMP WITH OVERLAPPING ROTOR AND HOUSING PORTIONS

[75] Inventor: Hitoshi Ogawa, Himeji, Japan

[73] Assignee: Mitsubishi Denki Kabushiki Kaisha, Tokyo, Japan

[21] Appl. No.: 555,415

[22] Filed: Nov. 28, 1983

Related U.S. Application Data

[63] Continuation of Ser. No. 269,661, Jun. 2, 1981, abandoned.

[51] Int. Cl.[3] ..... F04C 2/00; F04C 15/00

[52] U.S. Cl. ..... 418/133; 418/270; 29/156.4 R

[58] Field of Search ..... 418/39, 70, 133, 182, 418/236–238, 259, 266–270; 29/156.4 R, 428

[56] References Cited

U.S. PATENT DOCUMENTS

| | | | |
|---|---|---|---|
| 884,747 | 4/1908 | Macnish | 418/182 |
| 1,021,320 | 3/1912 | Mason | 418/266 |
| 2,975,964 | 3/1961 | Osterkamp | 418/182 |
| 3,057,304 | 10/1962 | Rohde | 418/133 |
| 3,467,019 | 9/1969 | Simpkins et al. | 418/70 |
| 3,774,397 | 11/1973 | Engdahl | 418/266 |

FOREIGN PATENT DOCUMENTS

| | | | |
|---|---|---|---|
| 121473 | 6/1901 | Fed. Rep. of Germany | 418/266 |

*Primary Examiner*—John J. Vrablik
*Attorney, Agent, or Firm*—Wenderoth, Lind & Ponack

[57] ABSTRACT

A pump means has a housing having a cylindrical inner peripheral surface, a disc secured to the housing to constitute a working chamber together with it and provided with a central opening eccentric to the center of the inner peripheral surface of the housing, a rotor rotatively contained within the working chamber and adapted to be drivingly connected to a shaft introduced into the working chamber through the central opening of the disc, a number of radial vanes shiftably received within slots formed in the rotor and adapted to have their outer ends shiftably abut the cylindrical inner peripheral surface of the housing, and overlapping portions formed by a portion of the disc and a portion of the rotor so as to be in an overlapping relationship with each other in the direction of the shaft in a contacting or non-contacting state with each other.

3 Claims, 12 Drawing Figures

ROTARY VANE PUMP WITH OVERLAPPING ROTOR AND HOUSING PORTIONS

This application is a continuation of now abandoned application Ser. No. 269,661, filed June 2, 1981.

BACKGROUND OF THE INVENTION

This invention relates to a pump means, and more particularly to an eccentric type vane pump comprising a rotor, a housing rotatively containing the rotor and having a cylindrical inner peripheral surface the center of which is eccentric to the center of the rotor, and a number of radial vanes each shiftably received within a corresponding slot formed in the rotor.

In general this kind of eccentric type vane pump has a construction as shown in FIGS. 1 and 2 of the attached drawings. In the drawings the reference numeral 1 designates an end frame or bracket of an alternating current generator for an automobile not shown, 2 a shaft supported on end frame 1 by means of a bearing 3 and adapted to be driven by the alternating current generator, 2*a* a splined portion formed on shaft 2 at its free end, and 4 a rotor fixedly secured to shaft 2 by the engagement of splined portion 2*a* of shaft 2 and a splined portion 4*a* formed centrally within rotor 4. Rotor 4 has a number (four in the instant example) of radial slots at equi-angular intervals, each shiftably receiving a radial vane 5. A housing 6 is provided having a cylindrical inner peripheral surface the center of which is eccentric to the centers of shaft 2 and rotor 4, 7 designates a disc adapted to constitute a working chamber 15 of the pump in cooperation with shaft 2 and housing 6, 8 a seal means to hermetically seal housing 6 relative to disc 7, and 9 a seal means secured to disc 7 in contact with shaft 2 to hermetically seal working chamber 15 relative to the outside. Housing 6 and disc 7 are integrally secured together by means of a number of pins 10 so as to constitute a pump and are adapted to be mounted on end frame 1 of the alternating current generator by means of a plurality of bolts 11. 12, 13 and 14 designate an inlet port, an outlet port and a lubrication orifice, respectively, provided in housing 6, inlet port 12 being adapted to be connected to a vacuum tank not shown, and lubrication orifice 14 to a lubricating pump also not shown.

In operation, upon rotation of shaft 2 in the direction shown by the arrow, radial vanes 5 disposed within the slots formed in rotor 4 are urged radially owing to the centrifugal force applied thereto by the rotating rotor 4 so that their outer end surfaces shiftably slide on the inner peripheral surface of housing 6 so that they perform a pump action to suck air from the vacuum tank through inlet port 12 and dischange it through outlet port 13. The lubricant oil fed into housing 6 through lubrication orifice 14 lubricates the surfaces on vanes 5 and defining the slots formed in rotor 4 and is discharged through outlet port 13 entrained in the discharged air.

In a conventional eccentric type vane pump having the construction and operation as described above, when it is constituted as a pump proper as shown in FIGS. 3 and 4, i.e. the rotor 4 is not mounted on shaft 2, because the rotor 4 simply abuts the flat inside surfaces of the end wall of the housing 6 and the disc 7 without being journalled thereon, rotor 4 can freely wander about within working chamber 15 enclosed by housing 6 and disc 7. Therefore, when the pump is e.g. transported as a pump proper, vanes 5 may be damaged by rotor 4, and at the time of mounting of the pump proper onto a generator, since rotor 4 has been displaced from its proper position relative to shaft 2, the fitting of splined portion 2*a* of shaft 2 on splined portion 4*a* of rotor 4 is made difficult, resulting in possible damage to seal means 9 by the splined portion 2*a* of shaft 2, etc., causing a considerable decrease in the reliability of the pump means, etc.

SUMMARY OF THE INVENTION

It is a primary object of the present invention to provide an improved pump means of the type comprising a rotor, a number of radial vanes shiftably received therein, and a housing rotatively containing the rotor and having a cylindrical inner peripheral surface with an axis eccentric to the center of the rotor, the rotor being adapted to be connected to a shaft of e.g. an automobile alternating current generator, in which in the pump proper prior to its incorporation into the generator or the like it is possible to protect the vanes from being damaged by the rotor during the transportation, etc. of the pump proper and it is easy to position the center of the rotor relative to the center of the shaft of the generator, etc. at the time of their assembly.

In accordance with the present invention a pump means of the type referred to above is provided which comprises a housing having a cylindrical inner peripheral surface and provided with an inlet port and an outlet port, a disc secured to the housing to form a working chamber in the pump together with the housing and having a central opening eccentric to the center of the cylindrical inner peripheral surface of the housing, a rotor rotatively disposed within the working chamber and adapted to be detachably secured to a shaft projecting through the central opening of the disc, a number of radial vanes each shiftably received within a corresponding slot formed in the rotor and adapted to have its outer end surface always abut the cylindrical inner peripheral surface of the housing, and overlapping portions formed of a portion of the disc and a portion of the rotor such that both portions are maintained in a contact or a non-contact relationship with each other in the axial direction of the shaft.

BRIEF DESCRIPTION OF THE DRAWINGS

Other objects and advantages of the present invention will become more readily apparent from the following description taken in connection with the accompanying drawings which set forth by way of illustration and example certain embodiments of the present invention:

In FIGS. 5 to 12, parts which are similar to corresponding parts in FIGS. 1 to 4 have been similarly numbered.

DESCRIPTION OF THE PREFERRED EMBODIMENTS

Figure 1:
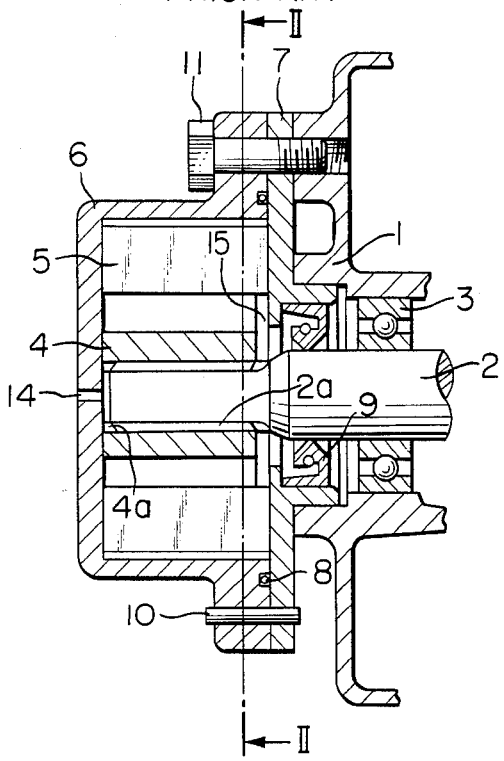
FIG. 1 PRIOR ART
FIG. 1 is a side elevational sectional view of a conventional pump means.
Figure 2:
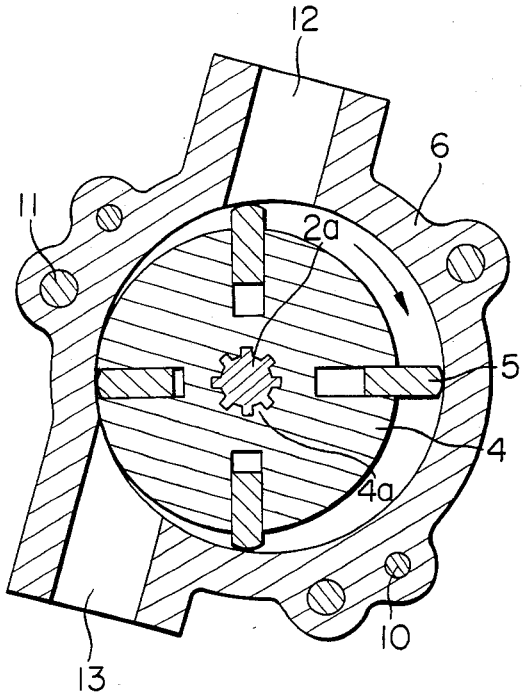
FIG. 2 PRIOR ART
FIG. 2 is a cross sectional view of the pump means shown in FIG. 1 taken along the line II—II of FIG. 1.
Figure 3:
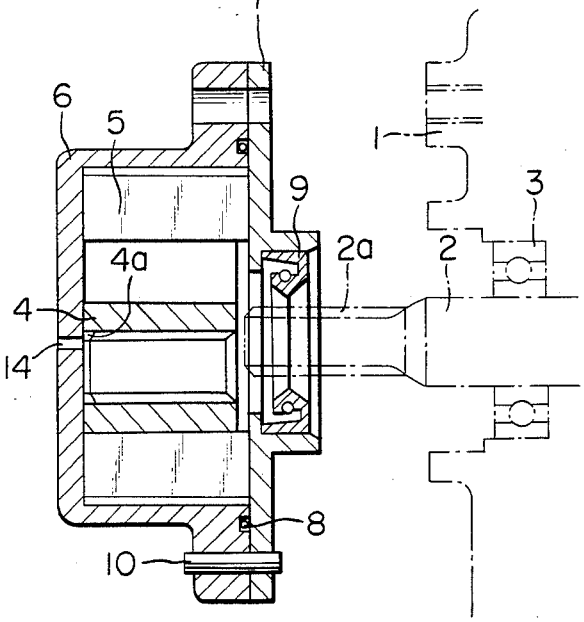
FIG. 3 PRIOR ART
FIG. 3 is a side elevational sectional view of the pump means shown in FIGS. 1 and 2 separated from the driving shaft and support.
Figure 4:
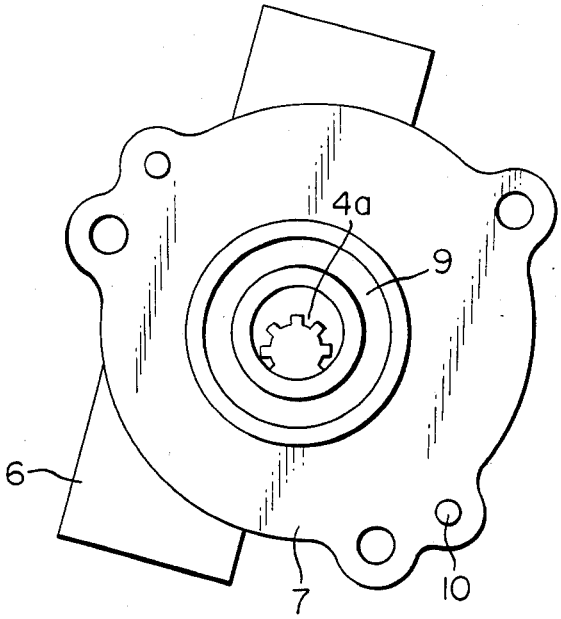
FIG. 4 PRIOR ART
FIG. 4 is a view of the pump proper shown in FIG. 3 as viewed from the right side of FIG. 3.
Figure 5:
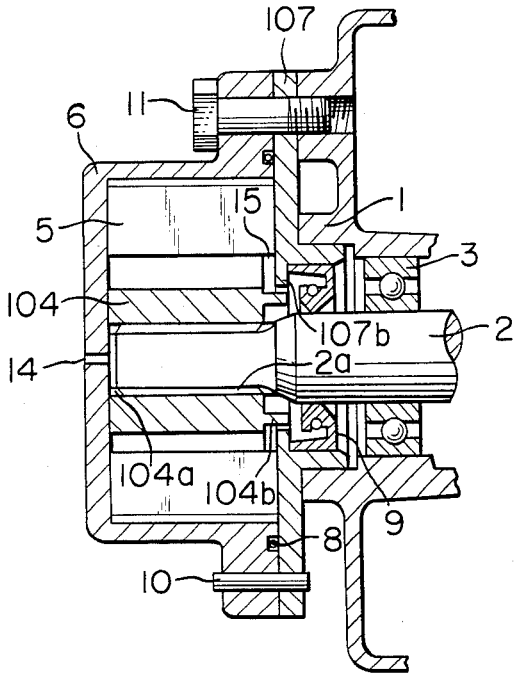
FIG. 5 is a side elevational sectional view of one embodiment of the present invention.

Referring first to FIG. 5 of the attached drawings showing the first embodiment of the present invention, the reference numeral 104 designates a rotor which is located within housing 6 eccentric to its cylindrical inner peripheral surface and adapted to shiftably carry a number of radial vanes 5 within slots formed therein. The end of the rotor 104 simply abuts the inner flat surface of the end wall of housing 6. 104*a* designates a splined portion formed in rotor 104 so as to be engageable with splined portion 2*a* of shaft 2, and 104*b* designates a cylindrical projection integral with and extending axially from the end surface of rotor 104 so the outer periphery thereof is opposed to the inner peripheral surface 107*b* of central opening 107*a* of disc 107 and which is adapted to serve as a positioning element for rotor 104, a predetermined clearance being left between the outer and inner surfaces of cylindrical projection 104*b* and inner peripheral surface 107*b* of disc 107, respectively, when the pump is assembled with an automotive alternating current generator.

In the embodiment having such a construction, by the provision of cylindircal projection 104*b* formed by axially elongating rotor 104, the movement of rotor 104 within housing 6 when the pump is not mounted on the generator is be limited by the engagement of cylindrical projection 104*b* with inner peripheral surface 107*b* of disc 107 so that the possible damage of vanes 5 by rotor 104 caused during the transportation of the pump, etc. can be effectively prevented, resulting in an easy placement of splined portion 2*a* of shaft 2 on splined portion 104*a* of rotor 104 at the time of assembly of the pump proper and the alternating current generator. The possible damage of seal means 9 by shaft 2 at the time of assembly is also prevented.

Further, owing to the provision of a clearance of a predetermined value between cylindrical projection 104*b* and inner peripheral surface 107*b* of disc 107, after the assembly of the pump proper and the generator there arises no danger of relative shift between cylindrical projection 104*b* and inner peripheral surface 107*b* of disc 107, so that the assembled pump means operates quite similarly to the conventional pump of this kind.

Figure 6:
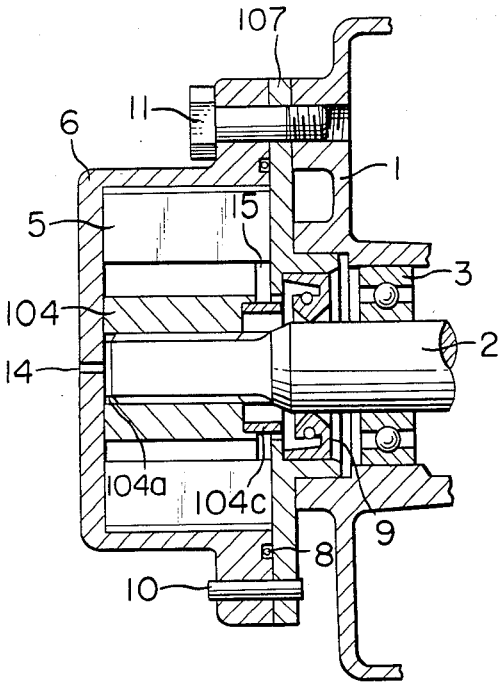
FIG. 6 is a view similar to FIG. 5, but showing a modification of the embodiment shown in FIG. 5.

Although cylindrical projection 104has been referred to in the above embodiment as being integral with rotor 104, it may be separately secured to rotor 104 as shown in FIG. 6 at 104*c* as a modified embodiment.

Further, in the above embodiments cylindrical projection 104*b* or 104*c* is shown as having a circular cross section, but it may have a cross section other than a circle, or alternatively, a number of separate axial projections may be formed on the end surface of rotor 104 instead of a whole cylindrical member being provided. In essence, the projection may have any desired configuration so long as it can act to limit the movement of rotor 104 relative to disc 107.

Next a second embodiment of the present invention will be explained in reference to FIG. 7, wherein the reference numeral 207 designates a disc defining the working chamber 15 of the pump together with pump housing 6 and shaft 2, and 207*a* is a cylindrical elongation integral with disc 207 around the central opening therein and extending axially towards the end of shaft 2, acting as a positioning element for shaft 2 during assembly. 204 designates a rotor eccentrically disposed within housing 6 relative to its cylindrical inner peripheral surface and shiftably receiving a number of radial vanes 5 within slots formed therein. 204*a* designates a splined portion formed in rotor 204 centrally thereof and adapted to be engaged with splined portion 2*a* of shaft 2, and 204*b* designates a groove provided in rotor 204 at its end confronting disc 207 and serving as a positioning element, whereby cylindrical elongation 207*a* of disc 207 axially overlaps at its free end portion the inner peripheral surface of groove 204*b* of rotor 204 with a radial clearance being left therebetween.

In this embodiment, having a construction as described above, because cylindrical elongation 207*a* of disc 207 extends into groove 204*b* of rotor 204, the movement of rotor 204 when the pump is not mounted is limited by the engagement of cylindrical elongation 207*a* of disc 207 and the inner peripheral surface of groove 204*b* of rotor 204 so that the possible damage of vanes 5 by rotor 204 caused during transport of the pump proper can be prevented and the engagement of splined portions 2*a* and 204*a* of shaft 2 and rotor 204, respectively, during the assembly of the pump proper and a generator is made easy.

Further, due to the existence of a predetermined clearance between the outer periphery of cylindrical elongation 207*a* of disc 207 and the inner periphery of groove 204*b* of rotor 204, after the assembly of the pump proper and the generator, cylindrical elongation 207*a* does not come into contact with the inner peripheral surface of groove 204*b* of rotor 204, therein operating similarly to a conventional pump means of this kind.

Figure 8:
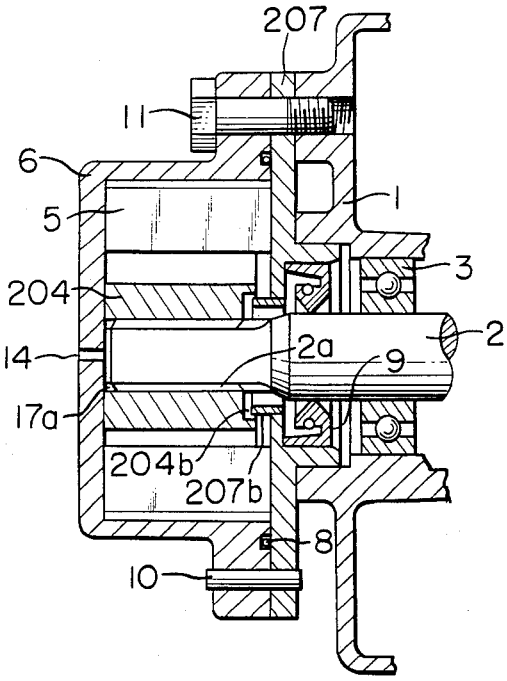
FIG. 8 is a view similar to FIG. 7, but showing a modification of the embodiment shown in FIG. 7.

Although the above embodiment has described the cylindrical elongation 207*a* as integral with disc 207, the same effect can be obtained also in the case where cylindrical elongation 207*b* is formed separately from disc 207 and attached thereto as shown in FIG. 8 as a modification of the second embodiment.

Figure 7:
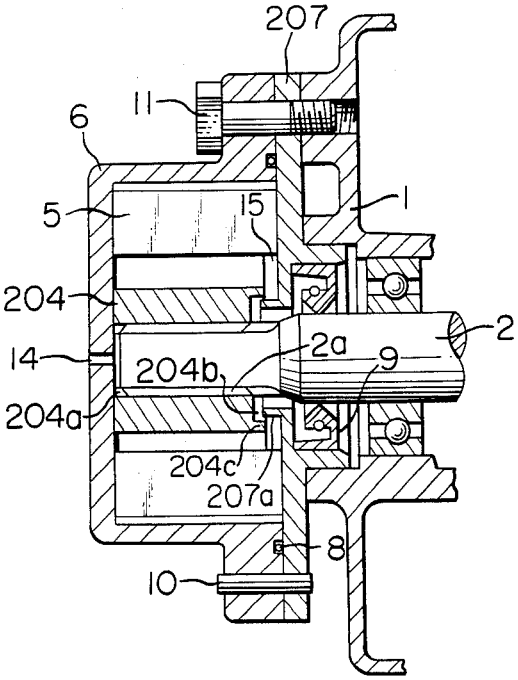
FIG. 7 is a side elevational sectional view of a second embodiment of the present invention.

Further, although in the above embodiments shown in FIGS. 7 and 8 cylindrical elongation 207*a* or 207*b* is provided on disc 207 for the purpose of acting as a positioning element for rotor 204, it is not necessary that same be shaped as a cylinder, instead it may be shaped as a number of separate projections extending from disc 207 near its central opening at intervals therearound.

Figure 9:
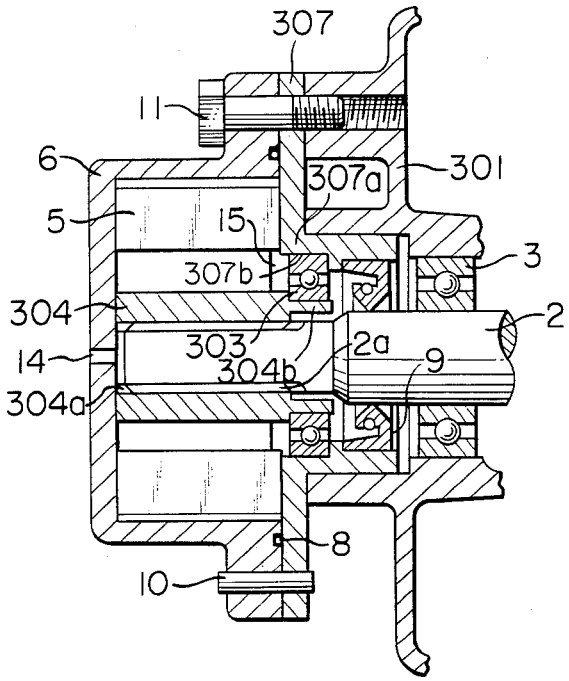
FIG. 9 is a side elevational sectional view of a third embodiment of the present invention.

FIG. 9 shows a third embodiment of the present invention, wherein the reference numeral 301 designates an end frame or bracket of an automobile alternating current generator, the cylindrical portion of frame 301 extending leftwards as viewed in FIG. 9 and being longer in the axial direction than in the case of a conventional generator as shown in FIGS. 1 to 4. 304 designates a rotor contained within housing 6, adapted to be rotated by shaft 2, and shiftably receiving a number of radial vanes 5 within corresponding slots formed therein, 304*a* a splined portion formed in rotor 304, and 304*b* designates a cylindrical elongation integrally formed on rotor 304 on the end adjoining bracket 301.

307 designates a disc which forms a working chamber 15 of a pump together with housing 6 and shaft 2, and 307*a* designates the inner peripheral surface of a central opening formed in disc 307 so as to radially confront the outer periphery of cylindrical elongation 304*b* of rotor 304 with a definite clearance being left therebetween. 303 is a bearing disposed between the outer periphery of cylindrical elongation 304*b* of rotor 304 and inner peripheral surface 307*b* of the central opening of disc 307 so as to rotatively support rotor 304 and at the same time to serve as a positioning element for rotor 304.

In the third embodiment, having a construction as described above, owing to the provision of bearing 303 between cylindrical elongation 304*b* and inner peripheral surface 307*b* of disc 307, the movement of rotor 304 within housing 6 when the pump is not mounted is limited by the engagement of cylindrical elongation 304*b* of rotor 304 with bearing 303, resulting in protecting vanes 5 from being damaged by rotor 304 at the time of transportation of the pump and at the same time making the engagement of splined portions 2*a* and 304*a* of shaft 2 and rotor 304, respectively, easy at the time of assembly of the pump proper and the generator.

Further, since bearing 303 is left in position after assembly, the pump means guarantees sufficient mechanical strength and operates quite similarly to a conventional pump means of this kind.

Figure 10:
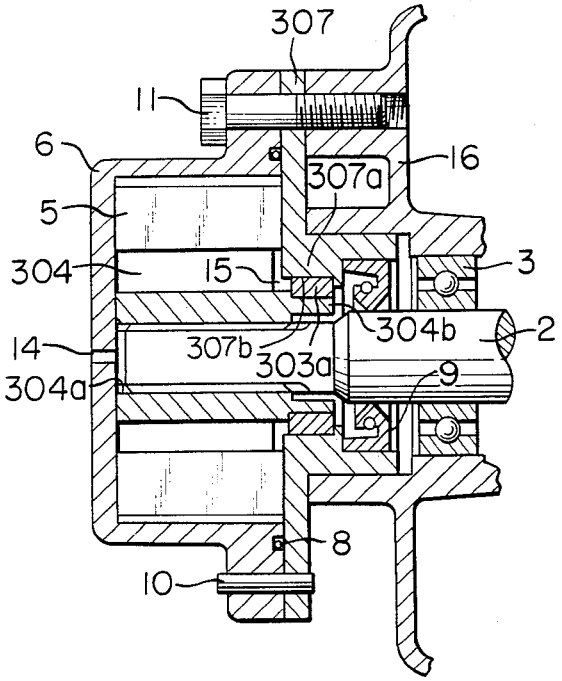
FIG. 10 is a view similar to FIG. 9, but showing a modification of the embodiment shown in FIG. 9.

Although in the above embodiment bearing 303 disposed between cylindrical elongation 304*b* of rotor 304 and inner peripheral surface 307*a* of disc 307 is referred to and shown as being a ball bearing, it may be any shiftable element 303*a* such as a plain bearing, a sleeve, a self-lubricating bearing, etc. as shown in FIG. 10 as a modification of the third embodiment, having the same effects as in the embodiment shown in FIG. 9.

Further, it should be added that although cylindrical elongation 304*b* of rotor 304 has been referred to and shown as being integral with rotor 304, it may be separably moved on rotor 304.

Figure 11:
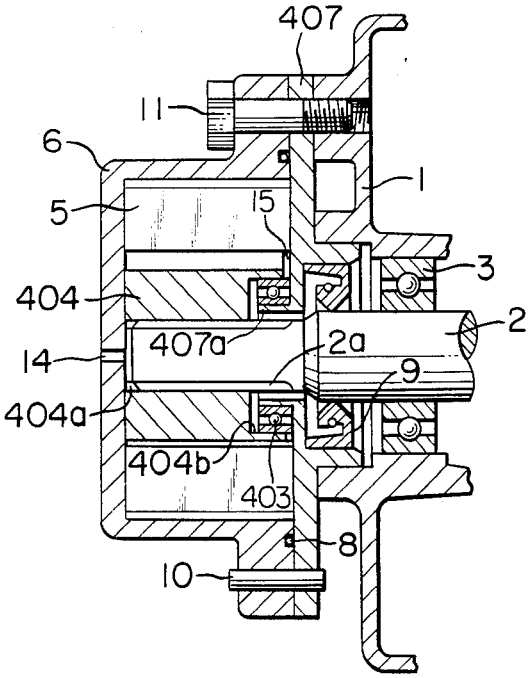
FIG. 11 is a side elevational sectional view of a fourth embodiment of the present invention.

Finally a fourth embodiment of the present invention will be described with reference to FIG. 11, wherein the reference numeral 404 designates a rotor shiftably receiving a number of radial vanes 5 within slots formed therein and adapted to be driven by shaft 2 of an automobile alternating current generator, 404*a* designates a splined portion formed centrally about rotor 404, 404*b* a groove formed in rotor 404 at the end adjoining the generator, 407 a disc constituting a working chamber 15 of the pump in association with housing 6 and shaft 2, and 407*a* an inner cylindrical elongation integrally formed around the periphery of a central opening of disc 407 so as to project axially in a direction opposite to the generator and confront the inner peripheral surface of groove 404*b* of rotor 404 with a definite clearance being left therebetween. 403 designates a bearing or ball bearing disposed between the inner peripheral surface of groove 404*b* of rotor 404 and the outer peripheral surface of inner cylindrical elongation 407*a* of disc 407 so as to rotatively support rotor 404 and at the same time serve to position rotor 404 within working chamber 15.

In this embodiment, having a construction as described above, owing to the provision of ball bearing 403 disposed between the inner peripheral surface of groove 404*b* of rotor 404 and the outer peripheral surface of inner cylindrical elongation 407*a* of disc 407, the movement of rotor 404 of the pump proper within housing 6 can be limited by the engagement of the inner peripheral surface of groove 404*b* of rotor 404 with the outer peripheral surface of inner cylindrical elongation 407*a* of disc 407 through ball bearing 403, resulting in protecting vanes 5 from being damaged by rotor 404 of the pump proper during its transportation, and at the same time the engagement of splined portions 2*a* and 404*a* of shaft 2 and rotor 404, respectively, at the time of assembly of the pump proper and the generator is made easy.

After the pump proper has been mounted on the generator, since ball bearing 403 is left in position, it assures sufficient mechanical strength and operates quite similarly to a conventional pump means of this kind.

Figure 12:
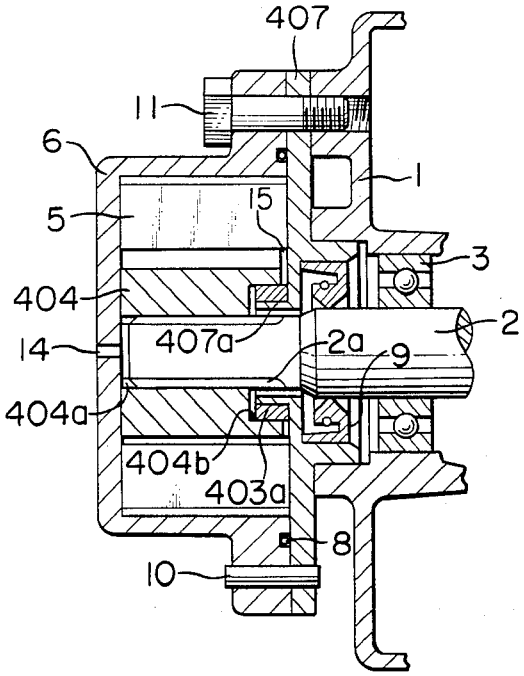
FIG. 12 is a view similar to FIG. 11, but showing a modification of the embodiment shown in FIG. 11.

Although, in the fourth embodiment, ball bearing 403 has been referred to as being disposed between the outer peripheral surface of inner cylindrical elongation 407*a* of disc 407 and the inner peripheral surface of groove 404*b* of rotor 404, as a modification, instead of ball bearing 403, a shifting means such as a plain bearing, a sleeve, a self-lubricating bearing, etc. may be used as shown in FIG. 12 at 403*a*.

While there have been described and illustrated herein certain embodiments of the present invention, it will be understood that modifications may be made without departing from the spirit of the present invention.

What is claimed is:

1. A pump means comprising: a housing means having a cylindrical inner peripheral surface and provided with an inlet port and an outlet port, an integral end wall with an inner surface closing one end and the other end being open; a disc means secured to said open end of said housing means to constitute a working chamber together therewith and having a central opening eccentric to the center of said cylindrical inner surface of said housing means, a rotor means rotatively contained within said working chamber and abutting only in sliding relationship against said end wall and said disc means for permitting radial sliding movement relative thereto and having a splined axial bore therethrough adapted to slide onto a splined shaft introduced into said working chamber through said central opening of said disc means, a plurality of radial vanes each shiftably received within a corresponding slot in said rotor means and adapted to have its outer end surface always shiftably abut against said cylindrical inner surface of said housing means, and means for limiting radial sliding movement of said rotor within said working chamber when said rotor is not secured on a shaft and consisting of an overlapping portion on at least one of said disc means and said rotor means and extending axially thereof into axial overlapping relation with the other of said disc means and said rotor means and having a peripheral surface spaced radially a slight distance from the other of said disc means and said rotor means.

2. A pump means as claimed in claim 1 wherein said overlapping portion comprises a projecting portion projecting axially from said rotor means into said central opening of said disc means so as to confront the inner periphery of said central opening of said disc means.

3. A pump means as claimed in claim 1 wherein said overlapping portion comprises a projecting portion projecting axially from said disc means towards said rotor means, and said rotor means has a groove therein into which said projecting portion on said disc means projects so as to overlap the part of said rotor defining said groove.

* * * * *